US010864565B2

(12) United States Patent
Kohlrausch et al.

(10) Patent No.: US 10,864,565 B2
(45) Date of Patent: Dec. 15, 2020

(54) SURFACE TEXTURING OF DEFORMING TOOLS

(71) Applicant: SMS Group GmbH, Duesseldorf (DE)

(72) Inventors: Arnt Kohlrausch, Kreuztal (DE); Hartmut Pawelski, Ratingen (DE); Markus Schellmann, Siegen (DE)

(73) Assignee: SMS Group GmbH, Duesseldorf (DE)

( * ) Notice: Subject to any disclaimer, the term of this patent is extended or adjusted under 35 U.S.C. 154(b) by 682 days.

(21) Appl. No.: 15/531,030

(22) PCT Filed: Oct. 21, 2015

(86) PCT No.: PCT/EP2015/074288

§ 371 (c)(1),
(2) Date: May 26, 2017

(87) PCT Pub. No.: WO2016/083026

PCT Pub. Date: Jun. 2, 2016

(65) Prior Publication Data

US 2017/0320114 A1 Nov. 9, 2017

(30) Foreign Application Priority Data

Nov. 28, 2014 (DE) ..... 10 2014 224 413
Dec. 23, 2014 (DE) ..... 10 2014 226 970

(51) Int. Cl.
*B21B 27/00* (2006.01)
*B21H 8/00* (2006.01)
(Continued)

(52) U.S. Cl.
CPC ..... *B21B 27/005* (2013.01); *B21B 1/227* (2013.01); *B21H 8/005* (2013.01); *B31F 1/07* (2013.01);
(Continued)

(58) Field of Classification Search
CPC . B21B 27/005; B21B 1/227; B21B 2001/228; B21B 27/00; B31F 1/07;
(Continued)

(56) References Cited

U.S. PATENT DOCUMENTS 4,329,562 A 5/1982 Christian
5,521,030 A * 5/1996 McGrew ..... G03F 7/00 204/192.34
(Continued)

FOREIGN PATENT DOCUMENTS

CN 1087846 6/1994
CN 201150928 11/2008
(Continued)

OTHER PUBLICATIONS

J. Staeves, Dissertation (Extract) University of Darmstadt, 1998 (Extract).
(Continued)

*Primary Examiner* — Sarang Afzali
(74) *Attorney, Agent, or Firm* — Abelman, Frayne & Schwab; Stefan Knirr

(57) ABSTRACT

A method of producing a deforming tool (2) having a structured embossing surface (4) which can be brought into contact with a surface of a substrate (1) for plastic deformation of the substrate, includes the steps of determining a target structure to be produced on the substrate (1); geometrically distorting the target structure, such that an embossing image structure is obtained; inverting the embossing image structure, such that the embossing structure for the embossed surface (4) is obtained; and producing the embossing surface (4) of the deforming tool (2) according to the embossing structure.

10 Claims, 1 Drawing Sheet

(51) Int. Cl.

| | |
|---|---|
| ***B44B 5/00*** | (2006.01) |
| ***B31F 1/07*** | (2006.01) |
| ***B21B 1/22*** | (2006.01) |
| *B44B 5/02* | (2006.01) |

(52) U.S. Cl.
CPC ..... *B44B 5/0047* (2013.01); *B21B 2001/228* (2013.01); *B44B 5/026* (2013.01); *Y10T 29/4956* (2015.01)

(58) Field of Classification Search
CPC ..... B44B 5/0047; B44B 5/026; B21H 8/005; B21H 8/00; Y10T 29/4956; Y10T 29/49565
See application file for complete search history.

(56) References Cited

U.S. PATENT DOCUMENTS

| | | | | |
|---|---|---|---|---|
| 5,709,952 | A | 1/1998 | Juergen | |
| 5,789,066 | A | 8/1998 | DeMare | |
| 5,857,373 | A * | 1/1999 | De Mare | B21B 1/227 72/252.5 |
| 2005/0066701 | A1 | 3/2005 | Holliday | |
| 2005/0115296 | A1 | 6/2005 | Plerre | |
| 2015/0273648 | A1 * | 10/2015 | Samuel | B24B 31/003 72/352 |

FOREIGN PATENT DOCUMENTS

| | | |
|---|---|---|
| JP | 5234758 | 3/1977 |
| JP | 61-99902 | 1/1986 |
| JP | 619902 | 1/1986 |
| JP | 6376722 | 4/1988 |
| JP | 03104537 | 5/1991 |
| JP | 04-200908 | 7/1992 |
| JP | 04200908 | 7/1992 |
| JP | 05-92283 | 4/1993 |
| JP | 0592283 | 4/1993 |
| JP | 08243657 | 9/1996 |
| JP | 2005-246432 | 9/2005 |
| JP | 2005246432 | 9/2005 |

OTHER PUBLICATIONS

Dissertation of J. Staeves, Dressierverfahren(Skin-Pass Process), University of Darmstadt, 1998.
Liu Chunming, Model Industry, No. 3, Mar. 1992, pp. 38-41.

* cited by examiner

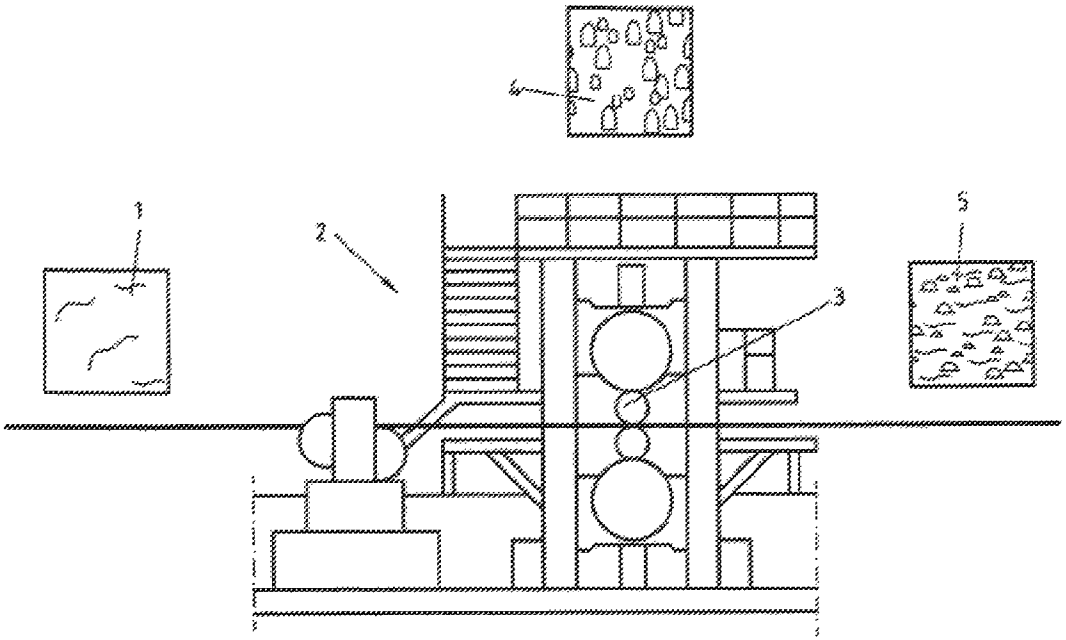
1
2
3
4
5

SURFACE TEXTURING OF DEFORMING TOOLS

RELATED APPLICATIONS

This application is a National phase application of International Application PCT/EP2015/074288 filed Oct. 21, 2015 and designating the U.S.A. and claiming priority of German applications DE 10 2014 224 413.7 filed Nov. 28, 2014 and DE 10 2014 226 990.9 filed Dec. 23, 2014, all three applications are incorporated herein by reference thereto.

BACKGROUND OF THE INVENTION

1. Field of the Invention

The invention relates to a method for producing a deforming tool having a structured embossing surface which can be brought into contact with a surface of a substrate for plastic deformation thereof (of the substrate). The invention further relates to such a deforming tool.

2. Description of the Prior Art

In plastic deforming processes, often embossing surfaces, e.g. the surface of a working roll in a roll stand, which surfaces have specially structured surface textures, are employed. With this arrangement, the objective is to create an embossed surface in the structure of the substrate, by plastic deformation, by means of a textured surface structure. Such embossing, which is imposed over a roughness structure which is already near the surface and is a consequence of characteristics of the material and/or of a process, may be motivated by considerations of optical, tribological, materials science, or joining technology factors, or a combination of these.

The following is a brief outline of an exemplary process sequence for surface embossing of sheets or plates (e.g. of metal) in a so-called "dressing process": For cold rolling, rolls with a defined roughness are used, such that the conditions for gripping and lubrication for the deformation are met. E.g. it is known to increase the roughness of the last pair of rolls in a cold rolling mill, so that the surfaces of individual windings in a coil do not adhere to each other when annealing is carried out. During the rolling process, the roughness of the rolls is transferred to (embossed onto) the sheet or plate. After the cold rolling, the sheets (or plates) are annealed, in order to provide the necessary deformability characteristics for the following deep drawing. For reasons of process technology, it is difficult to avoid changes of the surface structures in the course of the annealing. After the annealing, the sheet or plate also has a well defined limit of elongation, which can result in deformation figures ("flow figures") in the deformation process. These generally undesirable effects can be reduced or eliminated in the sheet or plate in subsequent re-rolling steps. Re-rolling is also employed to arrive at a final surface texturing. The dressing rolls impose a different structure on the structure delivered from the cold rolling and annealing.

In order to produce a special embossing structure in the dressing roll, various techniques are available, including the following: shot blast texturing (SBT), electrical discharge texturing (EDT), laser texturing (LT), electron beam texturing (EBT), and Pretex texturing.

In the process of deforming the substrate for the purpose of structuring of the surface, plastic deformation occurs not only in the vicinity of the surface but a material flow occurs along at least one other direction. Continuing with the example of a rolling process, here the thickness of the substrate is reduced, which in particular leads to a lengthening. Such a lengthening is generally desired and desirable, and in any event is unavoidable. It leads to elongation of the material in the rolling direction. Expansion transversely to the rolling direction is minimal or does not occur at all.

The result of the elongation (or generally speaking the deformation) along one or more main directions is that a structure present on or applied to the surface is geometrically distorted in accordance with the degree of deformation along the main directions (which in the case of rolling correspond to the thickness reduction and the elongation). E.g. an originally circular structure will be deformed into an ellipse having its main axis parallel to the direction of the rolling.

This distortion which occurs in the processing can adversely affect the quality of the embossing to a substantial degree. As a rule, one seeks an un-distorted rendering of the "embossing image structure", which will be achieved only if one avoids deformation along directions which are not involved in texturing, thus along the abovementioned main directions. Thus a conflict occurs in that, in plastic deformation with surface texturing, a high quality of embossing conflicts with a high degree of deformation. A high degree of deformation along one or more main directions, thus a substantial reduction in the material at constant mass flow, represents high productivity. Thus high productivity is counter to the interest of high quality of the surface texture.

Although the example of a rolling process is being discussed here as a principal example of plastic deformation, relating to the above-described problem of surface texturing, the difficulties which arise are also present in other mechanical plastic deformation processes, including discontinuous processes; e.g. forging, embossing, stamping, plating, etc.

SUMMARY OF THE INVENTION

It is an object of the invention to devise a deforming tool and a method of producing such a tool, whereby one can achieve a high degree of deformation with improved quality of the embossed surface.

This problem is solved by a method having the features of claim 1, and a deforming tool having the features of claim 10. Advantageous refinements follow from the dependent claims, the following further description of the invention, and the description of preferred exemplary embodiments.

The inventive method is useful for producing a deforming tool which has a structured embossing surface. The structured embossing surface can be brought into contact with a surface of a substrate for plastic deformation thereof (of the substrate). In the case of the preferred rolling process, the substrate is, e.g., a metal sheet or plate which is to be rolled, and the embossing surface is preferably the peripheral surface of a working roll, e.g. a dressing roll. However, the invention is suitable also for other deforming processes, e.g. forging, embossing, stamping, and plating.

First, a determination is made of a target structure which is to be produced on the substrate; this structure is also referred to as a "texture". It is the surface profile which is sought to be produced by means of plastic deforming. The target structure may be represented, e.g., as a two-dimensional function, describing a pattern of peaks and valleys depending on the position on the surface. Preferably the target structure is isotropic, i.e. is directionally independent, at least in some respect. The definition of the target structure may also contain a parameter of roughness (e.g. mean roughness, quadratic roughness, mean depth of the roughness, the number of peaks, etc.). In the past, undesirable distortion of the target structure has occurred particularly in structures having high roughness or a high degree of deformation. This problem is solved by the invention, and thus the invention is particularly well suited for target structures of this type.

The target structure is then subjected to geometric distortion, resulting in a structure which in the present text is designated as an "embossing image structure". The geometric distortion includes compression and expansion of the target structure. The purpose of this transformation is to compensate for an unavoidable and mostly desirable deformation of the substrate along one or more main directions. The term "main direction" refers to a direction which is not defined by the profiling and texturing, and along which the substrate is nonetheless plastically deformed during the profile creation. In the case of a deforming process consisting of the above-described rolling process, for example, the "main direction" is the direction of rolling, because an expansion (elongation) of the material occurs along the direction of rolling, but not as a result of the subject structuring itself. There is no (or only minimal) expansion transversely to the direction of rolling (in the plane of the substrate), so that in the rolling process one may expect deformation along only one direction. Stated differently, this means that planar deformation occurs only in the longitudinal and thickness directions, and not the width direction, so that in terms of the surface the deformation occurs only in one main direction, namely the longitudinal direction. As a general proposition, however, the deformation can occur along a plurality of main directions. In the case of rolling, the geometric transformation thus compensates for the elongation of the substrate in the direction of rolling. If, e.g., the target structure is comprised of a plurality of circles, in the context of the geometric distortion these are intentionally converted to (compressed into) ellipses having their main axes oriented transversely to the direction of rolling.

Then the "embossing image structure" is inverted, resulting in a structure which will be referred to as the "embossing structure". The embossing surface of the deforming tool is then fabricated according to the thus obtained "embossing structure". In other words, the embossing structure is the structure with which the embossing surface of the deforming tool will be provided.

The invention enables a high degree of embossing from the tool to the substrate, without unintended distortions in the target texture. High degrees of roughness may be realized, without having a negative effect on the quality of the target structure. In particular, using the method proposed here, it is possible to produce regular and/or isotropic structures having a high degree of deformation. This is in contrast to prior stochastic structures, in which one can immediately see distortion. In the past, in order to improve quality it was necessary to resort to large roll diameters, low degrees of deformation, and/or other technical solutions that were fraught with drawbacks. The invention solves these problems. In particular, the invention contributes to improvement of the surface quality as regards optical, tribological, materials science, or joining technology factors, and/or a combination of these other characteristics. All this can be realized in combination with substantially high degrees of deformation and/or embossing, resulting in increased productivity without structural modification of the deforming apparatus. Thus the invention can be realized with only small modifications of the tool.

Preferably, the target structure is described by a transfer function the parameters and arguments of which are comprised of the embossing structure and one or more process parameters. These process parameters describe the deformation behavior of the substrate during the plastic deformation, along one or more main directions. The term "process parameter" in the present text is understood to have its general meaning, and encompasses parameters of the substrate undergoing processing and parameters which describe the characteristics of the deforming tool. E.g., in the case of rolling of a plate or strip, the deformation along a main direction may depend on the substrate thickness, e.g. the thickness of the plate or strip. The deformability may also depend on the "flow stress" of the material. The deformation behavior of the substrate may also be influenced by a geometric parameter, e.g., in the rolling process, the diameter of the roll. The greater the roll diameter the less the elongation in the rolling direction. Other parameters which may play a role in this regard are: the embossing speed, e.g. in a rolling process the rolling speed, the tension along one or more main directions during the deforming, a coefficient of friction between the embossing tool and the substrate, and/or another measure of the expansion of the material.

Preferably, the embossing structure has an anisotropic geometric characteristic which becomes isotropic as expressed in the corresponding target structure. In this connection, the embossing structure may be anisotropic overall, e.g. it may be directionally dependent (wherewith analogously the target structure may be isotropic overall, i.e. directionally independent), or only one or more geometric characteristics of the structure may be provided in an anisotropic (or isotropic) form. E.g., if the target structure is comprised of a plurality of circles, these circles may be anisotropically distributed. Nonetheless, the structure will have a corresponding isotropic characteristic, the circles. In the embossing structure, these circles will be converted (compressed) into ellipses.

Suitable techniques for producing the embossing structure are the so-called shot blast texturing (SBT), electrical discharge texturing (EDT), laser texturing (LT), electron beam texturing (EBT), and Pretex texturing techniques. In shot blast texturing, macroscopic particles are accelerated onto the embossing surface from a blasting wheel. When they impinge on the embossing surface, the particles plastically deform the surface, and they may dislodge material. The roughness may be adjusted by adjusting: the speed of the blasting wheel, the blasting material, the hardness of the embossing surface, the throughput of the blasting material, and/or the duration of treatment. In electrical discharge texturing, electrodes are moved along the preferably moving embossing surface (e.g. near the rotating roll surface) without touching it. A high voltage pulse from an electrical generator is applied, which gives rise to a sufficiently high electrical field strength between the electrode and the substrate that a spark discharge occurs in the dielectric between two poles. A "burning current" flows in the electric are which forms.

A small region of the embossing surface undergoes melting. Gas bubbles form in the dielectric. When the eroding pulse is switched off, the gas bubbles and the molten material are expelled. The degree of roughness can be adjusted by adjusting the hardness of the embossing surface, and/or by adjusting parameters such as the voltage, the current, the control time, and the distance between the electrodes. In comparison to SBT, with EDT it is possible to produce higher numbers of peaks and lower roughnesses, with higher reproducibility. In laser texturing, a laser beam is focused on the embossing surface, and melts a small area of the surface. A "chopper wheel" or a suitable electronic control means interrupts the beam, and the melt is expelled by the pressure of the plasma and an inert gas. As a result, the melt accumulates either to form a bead around the edge of the crater or builds up on one side of the crater, and it hardens there. To adjust the roughness, it may be possible to adjust, e.g., the laser power, the advance of the laser beam, the rotational speed of the "chopper wheel", or the inert gas. In electron beam texturing, an electron beam is used for melting the material of the embossing surface. Part of the molten material is vaporized, so that the vapor pressure results in buildup of a ring around the crater. In the Pretex technique, the embossing surface undergoes hard chrome plating by an electrolytic process. By control of the voltage between the anode and the embossing surface (serving as the cathode), structural elements having the shape of spherical segments are deposited on the surface.

The invention further relates to a deforming tool which has a structured embossing surface which can be brought into contact with a surface of a substrate for plastic deformation thereof (of the substrate), which deforming tool is produced by the inventive method and/or one or more preferred refinements or embodiments of the inventive method. In particular, the structure of the embossing surface of the deforming tool preferably has an anisotropic geometric characteristic. If the embossing surface is part of a working roll, the structure of the embossing surface preferably has a plurality of elliptically shaped features (figures, forms, or patterns) which have their main axes oriented transversely to the rolling direction. Preferably, the main axes of all of the elliptical features of the embossing surface are oriented transversely to the rolling direction.

Although the invention is particularly applicable in the area of technology of tools for plastic deformation and structuring, particularly tools such as working rolls and dressing rolls, the invention may be adaptable for use in other areas. In addition, other advantages and features of the invention will be apparent from the following description of preferred exemplary embodiments. The features described there may be employed (and adapted) individually or in combination with one or more of the abovementioned features, where practicable. In this connection, the following description of preferred exemplary embodiments is presented with reference to the accompanying drawings.

BRIEF DESCRIPTION OF THE DRAWINGS

FIG. 1 illustrates schematically the progress of a re-rolling process, wherein a metal strip or the like is plastically embossed with a structure by means of a structured embossing surface.

DETAILED DESCRIPTION OF THE PREFERRED EMBODIMENTS

In the following, advantageous exemplary embodiments of the invention are described in detail, with reference to the FIGURE. It should be noted that the herein-described exemplary embodiments are not intended to limit the scope of the invention, but rather they serve to aid in describing and clarifying the invention, in which connection the features represented, or combinations of these, in the exemplary embodiments, should not all be deemed essential for the invention.

FIG. 1 shows schematically a process of re-rolling of a metal strip (or plate) 1, which serves as an example of the general designation "substrate". The reference numeral 1 refers not only to a metal strip but also the surface structure of the metal strip which may be present at the strip entrance portion of the rolling stand 2 prior to the re-rolling. At this location, the metal strip 1 has a surface structure OE, a value of strip thickness h, and a value of "flow stress" kf.

The rolling stand 2 brings about a suitable geometric structure and/or texture in a combined embossing and thickness reduction process, on one or both surfaces of the metal strip 1. In other words, not only is embossing effected on the surface structure of the metal strip, but also the strip experiences lengthening accompanied by thickness reduction. In addition to the texturing itself, there is deformation along a further skin direction, in the present case the longitudinal and transport direction of the strip 1. By combining these two process operations (lengthening and structuring) in one step, the productivity of the process can be increased. In addition, it is possible to achieve surface textures of a higher degree of deformation (higher degree of roughness), which would not be possible without such a combined deformation along one or more main directions, or would be possible only at great expense, e.g. would require a substantial increase in the roll diameter. In the present example, the working roll 3, namely the roll having an embossing surface with a particular surface structure, which structure it embosses on the substrate 1, has a diameter of only ca. 400 mm. Obviously, other diameters are possible. E.g., successful tests with a roll diameter of ca. 230 mm have been carried out. It is significant that embossing with rolls having relatively small diameters is possible, with an embossing quality which previously was only attainable with larger rolls. The diameter of the working roll is designated D. It should also be noted that it is possible to perform the embossing with a plurality of working rolls, e.g. if both sides of the strip are to be embossed, or if the pattern sought to be realized requires more than one embossing step.

The working roll 3 has an embossing surface 4 (see FIG. 1). The embossing surface 4 has a structure suited for embossing the substrate 1. The structure of the embossing surface 4 can be described with a function which will be designated "OW".

The resulting surface structure is the structure which, with passage through the roll stand 2, will be applied to the substrate 1, and will be designated surface structure 5; it is not only a function of OW but also depends on other process parameters, e.g. the elongation E which occurs as a consequence of the thickness reduction by the rolls, the roll speed v, the tension FE on the strip as it is being fed, the tension FA on the strip as it exits, and the friction p, in the roll gap. One or more of these parameters will determine the lengthening of the strip along the transport direction of the strip. The deformation which occurs distorts the structure intended to be imparted by the embossing surface 4 of the working roll 3, in particular resulting in an unintended "anisotropy" of the structure of the strip at the strip exit point.

The surface structure 5 which is present following the rolling step, i.e. at the exit from the roll stand 2, is described by a function "OA". OA has the following general form:

$$OA=f(OW,OE,D,h,kf,\varepsilon,v,FE,FA,\mu) \quad (1)$$

In the present context, the terms "isotropy" and "anisotropy" refer to one or more geometric characteristics which can be identified and compared in the embossing surface 4 and the target structure 5. E.g., if the embossing surface 4 of the working roll 3 has circles which result in ellipses having main axes parallel to the direction of transport, on the strip surface 5 at the exit of the roll stand 2, this is an example of the structure OW being anisotropic ally distorted.

In order to reduce the degree of anisotropy (or generally stated the distortion) of the rolling, as already mentioned it is possible to increase the diameter of the working roll, or to seek to increase the roll gap friction. Both of these options entail technical and/or process economics drawbacks, such as increasing the size of the apparatus and increasing the energy consumption.

The technical solution described in the following applies elsewhere as well. In the terminology used in connection with the above-described roll stand 2, the desired surface structure OA of the aluminum strip 1 is produced regardless of the degree of deformation by the working roll 3, by selecting a "compressed" (converted), generally distorted, surface texture OW. The distorted, generally anisotropic surface texture 4 of the working roll 3 is chosen as the inverse of the transfer function OA and is applied to the desired target texture OW. The structure defining the transfer function OA is referred to herein as the "embossing image structure".

The process is then a combined embossing and thickness reduction process carried out by the working roll 3, with a suitably geometrically distorted embossing structure, wherewith the desired target structure is achieved through the lengthening of the strip 1. The nature and the degree of the geometric distortion of the pattern on the embossing surface 4 are selected such that it corresponds to the inverse transfer function OA on the substrate 1:

$$OW=f^{1}(OA;OE,D,h,kf,\varepsilon,v,FE,FA,p) \quad (2)$$

In order to achieve a (the) fine adjustment of the embossing characteristics of the embossing roll 3, or of the apparatus in general, as applied to the substrate 1, one can modify additional process parameters, e.g. the tension on the strip at entry (at the entrance) FE and at exit FA, the elongation E, the roll speed v, and/or the friction p, (e.g. the lubrication) in the roll gap.

Exemplary Embodiment of the Transfer Function for Simple Elongation ("Stretching"):

OA is represented by a height profile zA(x, y);

OW is represented by a height profile zW(x, y);

x is the rolling direction;

y is the transverse direction.

$$zA(x,y)=-zW(x/(1+C_2*\varepsilon),y/C_1$$

with the factors C1, C2>0, which factors may be dependent on other process conditions such as h and The inverse is:

$$zW(x,y)=-C1*zA(x*(1+C2*\varepsilon),y)$$

A fine adjustment, e.g. by adjusting the elongation E and the strip tension at entrance $$\Delta OA=[\partial f(OW;OE,D,h,kf,\varepsilon,v,FE,FA,\mu)/\partial\varepsilon]\Delta\varepsilon+[\partial f(OW;OE,D,h,kf,\varepsilon,v,FE,FA,\mu)/\partial FE]\Delta FE$$

FE, is expressed as follows:

After the embossing structure is determined in this manner, the embossing surface can be produced. Various methods are available to accomplish this, e.g. shot blast texturing (SBT), electrical discharge texturing (EDT), laser texturing (LT), electron beam texturing (EBT), and Pretex texturing.

To the extent practicable, individual features described in the exemplary embodiments can be combined and or interchanged, without departing from the scope of the invention.

LIST OF REFERENCE NUMERALS

1 Substrate at the entrance point of the strip.

2 Roll stand.

3 Working roll.

4 Embossing surface.

5. Substrate having the target structure, at the exit point of the strip.

The invention claimed is:

1. A method of producing a deforming tool (2) having a structured embossing surface (4) which is brought into contact with a surface of a substrate (1) for plastic deformation of the substrate, the method comprising:

determining a target structure to be produced on the substrate (1);

geometrically transforming the target structure along at least one main direction along which the substrate is deformed during the plastic deformation, such that an embossing image structure is obtained;

inverting the obtained embossing image structure, such that an embossing structure for the structured embossing surface (4) is obtained; and producing the deforming tool (2) having the structured embossing surface (4) comprising the obtained embossing structure.

2. The method according to claim 1; characterized in that the target structure is defined by a transfer function the parameters of which comprise the embossing structure and one or more process parameters.

3. The method according to claim 2; characterized in that one or more of the process parameters describe the deformation behavior of the substrate (1) during the plastic deformation along one or more main directions.

4. The method according to claim 3; characterized in that the process parameters are comprised of at least one of the following parameters: a flow tension of the substrate (1), a geometric parameter of the embossing surface (4), an elongation of the substrate (1) in the deformation along a main direction, an embossing speed, a tension along the one or more main directions during the deformation, and a coefficient of friction between the embossing surface (4) and the substrate (1).

5. The method according to claim 1; characterized in that the deforming tool (2) comprises a working roll (30).

6. The method according to claim 5; characterized in that the target structure is described by a transfer function the parameters of which are comprised of the embossing structure and at least one of, the following parameters: a flow tension of the substrate (1), a diameter of the working roll (3), an elongation of the substrate (1) along the rolling direction, a rolling speed, the substrate tension at an entrance to the working roll (3), the substrate tension at an exit from the working roll (3), and the friction in the roll gap.

7. The method of claim 5, wherein the deforming tool comprises a dressing roll.

8. The method according to one claim 1; characterized in that the substrate (1) is a sheet or plate, preferably a sheet or plate of metal.

9. The method according to claim 1; characterized in that the embossing structure has an anisotropic characteristic, wherewith the corresponding characteristic in the target structure is isotropic.

10. The method according to claim 1; characterized in that the embossing surface (4) is produced by at least one of the following techniques: shot blast texturing (SBT), electrical discharge texturing (EDT), laser texturing (LT), electron beam texturing (EBT), and Pretex texturing.

* * * * *